United States Patent [19]

Syrowatka

[11] 4,302,871

[45] Dec. 1, 1981

[54] PRESS OR REVERSING ROLLER FOR DOUBLE SIEVE BAND DRAINAGE MACHINES

[75] Inventor: Rupert Syrowatka, Graz, Austria

[73] Assignee: Maschinenfabrik Andritz Aktiengesellschaft, Austria

[21] Appl. No.: 84,514

[22] Filed: Oct. 12, 1979

[30] Foreign Application Priority Data

Oct. 27, 1978 [AT] Austria ..... 7676/78

[51] Int. Cl.[3] ..... B21B 13/00

[52] U.S. Cl. ..... 29/110; 100/118; 29/125

[58] Field of Search ..... 29/110, 124, 125, 119, 29/130, 123; 100/118, 154; 210/386; 162/361

[56] References Cited

U.S. PATENT DOCUMENTS

| | | | |
|---|---|---|---|
| 1,764,456 | 6/1930 | Mantius | 162/361 X |
| 3,743,100 | 7/1973 | Bahr | 100/118 X |
| 4,222,433 | 9/1980 | Marti et al. | 29/124 X |

*Primary Examiner*—Peter P. Nerbun

*Attorney, Agent, or Firm*—James E. Bryan

[57] ABSTRACT

This invention relates to an improvement in a press or reversing roller for double sieve band dehydrating machines for dehydrating suspensions, particularly a press roller in which the sieves with an interposed sheet of material partially loop over the roller, the roller being provided in a multiple-piece manner over the sieve path, and wherein one step bearing is provided at the contact point of two adjacent rollers, the improvement comprising stationary covering means secured between end faces of adjacent rollers, said covering means having the same radius as said adjacent rollers at least in the looping area and serving as a glide shoe.

1 Claim, 2 Drawing Figures

PRESS OR REVERSING ROLLER FOR DOUBLE SIEVE BAND DRAINAGE MACHINES

Figure 1:
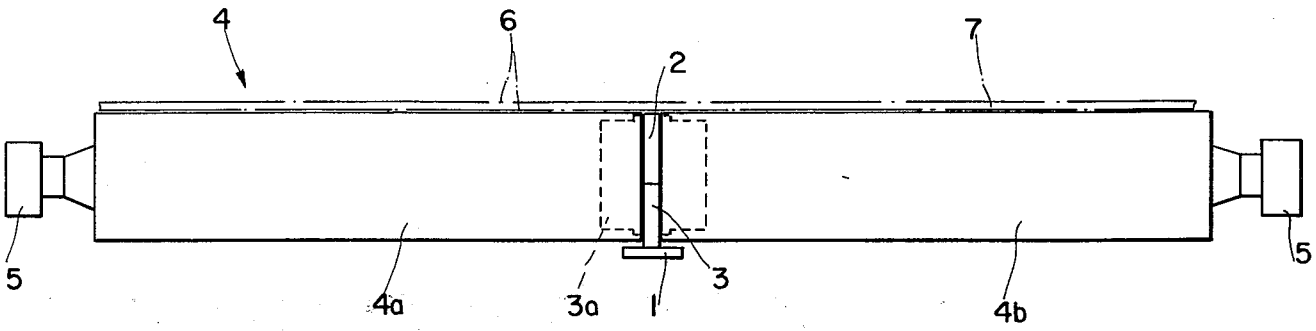

The present invention relates to a press or reversing roller for double sieve band water-removing or drainage machines for dehydrating or draining suspensions, particularly a press roller in which the sieve lengths with the interposed sheet of material are partially encircled and are provided in a multiple-piece manner over the width of the sieve, and one step bearing each is disposed at the contact point of two adjacent rollers.

Press or reversing rollers in double sieve band dehydrating or drainage machines serve for squeezing the liquid out of the suspension which is guided between two sieves and gradually subjected to increased pressure.

It is known in the art to provide press or reversing rollers which have the same length as the width of the sieve in order to obtain a seamless filter cake. The same holds true also for the dehydration of webs of paper because here also the requirement is first and foremost to manufacture the web of paper without noticeable seams or other imprinted unevennesses imprinted therein.

The requirement for an increased sheet velocity, and ultimately for a better efficiency of the machine requires a constant increase of the roller pressures, and therewith also a greater dimensioning of the roller diameter, in order to be able to withstand the high pressures. Because, however, the specific pressure has a relationship to the radius, it is advantageous to maintain the diameter of the rollers small in order to attain a high pressure. This requirement, however, cannot be met because, in that case, the rollers in wide machines have a length such that they invariably undergo a deflection in the center thereof and are no longer usable for dehydration or water removal or drainage.

A roller arrangement is known from U.S. Pat. No. 1,764,456 in which the rollers are made in a bipartite manner over the width of the sieve path. This makes it possible to accommodate an additional bearing in the roller center, or also makes possible a roller displacement in the traveling direction of the sieve. It is disadvantageous in this roller arrangement that now a dehydration in the central bearing area is no longer possible and therefore the filter cake has in that case too much residual moisture.

It also has been already proposed to provide over the width of the sieve path several individual rollers which have a relatively small roller diameter and are supported on a carrier by several bearings. In order to render it possible to dehydrate the entire width of the sheet of material without stages, the individual rollers are disposed in an interlocking manner. The result is a smooth sheet of material which is uniformly dehydrated in every area thereof. This arrangement is suitable, however, only for planar sheets of material.

Based on this state of the art it is the object of the present invention to provide a press roller with a small diameter for wide dehydrating or drainage machines which may be employed both as a supporting or a backing roller for a planar sheet of material and also as a reversing roller, which is multiply positioned and nevertheless dehydrates the sheet of material without stages.

According to the present invention this object is obtained by virtue of the fact that secured between the end faces of the successively arranged roller parts and over the bearing body is a stationary covering means which in the outer contour thereof has the same radius as the roller parts, at least in the area of band looping, and serves as a glide shoe.

Due to this construction of the divided press roller it is now possible to dehydrate sieve paths or sieve sheets, with an interposed sheet of material, over the entire width thereof without stages. It can be employed not only for planar sieve paths but also at reversing points as reversing rollers.

Figure 2:
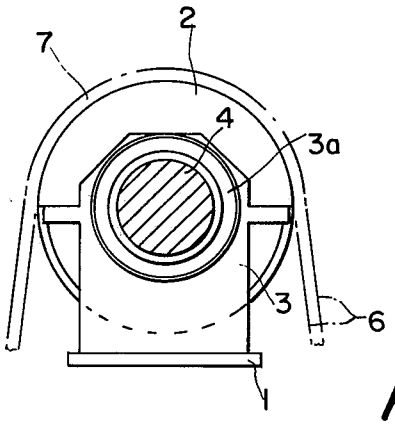

The present invention will be further described hereinbelow on the basis of one embodiment thereof with reference to the accompanying drawings, wherein FIG. 1 is a view of a press or reversing roller with a central bearing, and FIG. 2 illustrates the construction of the glide shoe.

Apparent from FIG. 1 is the view of a press roller 4 supported in the center thereof. This press roller 4 does not consist of one piece but of roller parts 4*a*, 4*b* and is positioned in the conventional manner at its end faces with outer bearings 5. It also contains in addition a central step or support bearing and the latter is composed of the bearing block 1, and the bearing body 3 over which a glide shoe 2 closes off the bearing point. The glide shoe 2 has the same radius as the press roller 4 and extends at least over the area of the looping of the sieve bands. The bearing body 3 with its bearings 3*a* is so provided that it is in part installed into the lateral wall of the roller parts 4*a*, 4*b* of the press roller 4. Here there are provided, for example, the ball bearings. The outer bearings 5 are connected in known manner with the frame of the machine. Further provided on the press roller 4 are the upper and lower sieves 6 with the sludge cake 7 positioned therebetween.

Shown in FIG. 2 is a cross-sectional view through the press roller 4 at the bearing point. Here again the bearing block 1 is evident in which the bearing cap or cover is constructed at the same time as a glide shoe 2. The upper and lower sieves 6 are drawn in at a specific looping angle with the sludge cake 7 disposed therebetween and are intended to make it clear that the looping may be about 180°. For this angle range also the glide shoe 2 must have the same radius as the press roller 4.

By virtue of this construction of the press roller 4 one achieves the fact that the roller diameter for the desired high contact pressure is smaller because, for example, a step or support bearing is positioned in the center of the roller. It is also possible to provide for several such step or support bearings, but it is essential that the glide shoe fills the gap between the two end faces of the roller in order to make it possible to obtain a filter cake without stages.

It will be obvious to those skilled in the art that many modifications may be made within the scope of the present invention without departing from the spirit thereof, and the invention includes all such modifications.

What is claimed is:

1. In a press or reversing roller for double sieve band dehydrating machines for dehydrating suspensions, particularly a press roller in which the sieves with an interposed sheet of material partially loop over the roller, the roller being provided in a multiple-piece manner over the sieve path, and wherein one step bearing is provided at the junction point of two adjacent rollers, the improvement comprising stationary covering means secured between end faces of adjacent rollers, said covering means having the same radius as said adjacent rollers at least in the looping area and serving as a glide shoe.

* * * * *